US007927205B2

(12) United States Patent
Toyoda

(10) Patent No.: US 7,927,205 B2
(45) Date of Patent: Apr. 19, 2011

(54) GAMING MACHINE

(75) Inventor: Hirobumi Toyoda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 881 days.

(21) Appl. No.: 11/902,121

(22) Filed: Sep. 19, 2007

(65) Prior Publication Data

US 2008/0076563 A1 Mar. 27, 2008

(30) Foreign Application Priority Data

Sep. 22, 2006 (JP) ..... 2006-258096

(51) Int. Cl.
*A63F 9/24* (2006.01)
*A63F 9/00* (2006.01)

(52) U.S. Cl. ..... 463/20; 463/29; 463/30; 463/31; 463/46; 273/457

(58) Field of Classification Search ..... 463/20, 463/29, 30, 46, 31; 273/457; 119/245
See application file for complete search history.

(56) References Cited

U.S. PATENT DOCUMENTS

2004/0018865 A1* 1/2004 Gilmore et al. ..... 463/7

FOREIGN PATENT DOCUMENTS

| | | |
|---|---|---|
| JP | 2001-046583 A | 2/2001 |
| JP | 2005-230190 A | 9/2005 |
| JP | 2006-141634 | 6/2006 |

* cited by examiner

*Primary Examiner* — David L Lewis
*Assistant Examiner* — Omkar Deodhar
(74) *Attorney, Agent, or Firm* — Arent Fox LLP

(57) ABSTRACT

A gaming machine is provided with improved visual effects by using a water tank, while facilitating the player's ability to visually recognize the information displayed by a display device. The gaming machine includes: a CPU 106 which controls execution of a game; mechanical reels 30A through 30C, each of which displays multiple kinds of indicating information variably and statically, and each of which is formed of a translucent material; a motor driving circuit 120 that controls the display operation of the mechanical reels 30A through 30C, which provides a function of displaying indicating information variably and statically; and a water tank 500 that is provided behind a display screen 10 for displaying the indicating information provided on the mechanical reels 30A through 30C, retains liquid, and is formed of a translucent material.

2 Claims, 7 Drawing Sheets

GAMING MACHINE

This application is based on and claims the benefit of priority from Japanese Patent Application No. 2006-258096, filed on 22 Sep. 2006, the content of which is incorporated herein by reference.

BACKGROUND OF THE INVENTION

1. Field of the Invention

The present invention relates to a gaming machine such as a slot machine, a pachinko-style slot machine, and a pachinko machine.

2. Related Art

With conventional gaming machines (slot machines), upon the player manipulating an operating means (start lever) after the insertion of a predetermined number of units of a gaming medium (coins or the like), a display means (reels or a liquid crystal display device), which displays multiple indicating information on the outer face thereof in the form of multiple lines (e.g., in the form of a 3×3 matrix), enters a scrolling display mode.

Furthermore, such gaming machines provide the following game. That is to say, upon the player operating the start lever, reels or the like are rotated a predetermined number of times (for a predetermined period of time), following which the rotation thereof is stopped. Then, such a gaming machine pays out an amount of coins based upon the combination of the indicating information rearranged along an active pay line provided to the display means, which allows the player to recognize the indicating information.

In addition, in recent years, various ideas have been proposed for improving visual effects. For example, an idea has been proposed for the aforementioned gaming machines, in which a hollow container filled with a liquid is provided forward of a lower panel of a cabinet of the slot machine. With such an arrangement, movable members such as simulated aquatic plants, simulated fish, etc., are provided within the hollow container. Furthermore, a bubble generator is provided to the hollow container, which provides bubbles in the liquid thus stored (see Patent document 1).

With the gaming machine disclosed in Patent document 1, the bubble generator provides bubbles to the liquid according to the progress and situations of the game, thereby providing improved visual effects.

However, with the gaming machine disclosed in Patent Document 1, such components are mounted at a different location from that of the display means that allows the player to recognize the indicating information of variable display, leading to a problem that such components do not attract much attention from the player. In order to solve this problem, a gaming machine is proposed in which a water tank is provided forward of the display means, which allows the player to recognize the indicating information of variable display displayed thereon. Such an arrangement provides improved visual effects, examples of which include bubbles provided within the water tank, visual effects provided by a transparent liquid crystal display device provided between the water tank and the display means, etc. (see Patent Documents 2 and 3).

With the gaming machines disclosed in Patent Documents 2 and 3, the water tank is provided forward of the display means, which allows the player to recognize the indicating information of variable display displayed thereon. Such an arrangement allows the player to recognize the indicating information of variable display displayed on the display means while viewing the visual effects provided by the water tank. Thus, such visual effects attract the player's attention.

[Patent Document 1]

Japanese Unexamined Patent Application, First Publication No. 2001-46583

[Patent Document 2]

Japanese Unexamined Patent Application, First Publication No. 2005-230190

[Patent Document 3]

Japanese Unexamined Patent Application, First Publication No. 2006-141634

However, there is a problem with the gaming machines disclosed in Patent Documents 2 and 3, which have a structure in which the water tank is provided forward of the display means. That is to say, with such an arrangement, the information provided by the display means is thus displayed to the player through the medium of the water tank. In some cases, if something interrupts the player's view, or if there is a large distance between the display means and the player, the player cannot recognize the information displayed by the display means. Such a problem limits the permissible size and shape of the water tank, leading to such a water tank providing only limited visual effects.

The present invention has been made in view of the aforementioned problem. It is an object of the present invention to provide a gaming machine which provides improved visual effects by using a water tank, while facilitating the player's ability to visually recognize the information displayed by the display means.

SUMMARY OF THE INVENTION

In order to achieve the aforementioned purpose, the present invention provides the following arrangements.

In a first aspect of the present invention, a gaming machine includes: a game control means for controlling execution of a game; a display means for providing a function of displaying multiple kinds of indicating information variably and statically, and which is formed of a translucent material; a display control means for controlling the display operation of the display means which displays indicating information variably and statically during the execution of the game under the control of the game control means; and a water tank, which is disposed behind a display screen of the display means for displaying indicating information, retains liquid, and is formed of a translucent material.

According to the first aspect of the present invention, the display means formed of a translucent material provides a function of displaying multiple kinds of indicating information variably and statically. The display control means controls the display operation of the display means, which provides a function of displaying the indicating information variably and statically, according to the execution of the game controlled by the game control means. Furthermore, the water tank, which is formed of a translucent material, and which is capable of retaining liquid, is provided behind the display screen of the display means that allows the indicating information to be displayed.

With such an arrangement, the water tank, which retains liquid, is provided behind the display screen of the display means, which provides a function of displaying the multiple kinds of indicating information variably and statically. Such an arrangement allows the player to recognize both the multiple kinds of indicating information displayed on the display screen of the display means and the water tank provided behind the display screen. Furthermore, such an arrangement can be designed without having to take into account a concern of whether or not the water tank interrupts the player's view of the display screen that displays the indicating information provided by the display means. With such an arrangement, the water tank can be formed with an increased depth as compared with an arrangement in which the water tank is provided forward of the display means. Such a water tank thus designed allows various kinds of items providing visual effects (e.g., simulated pirate ships, simulated tropical fish, simulated aquatic plants, all of which can be moved by magnetic force) to be arranged therewithin.

Thus, such an arrangement provides improved visual effects by using the water tank, while facilitating the player's ability to visually recognize the information displayed by the display means.

In a second aspect of the gaming machine as described in the first aspect of the present invention, the display means may include cylindrical reels which have multiple kinds of indicating information provided on the outer face thereof, and which are provided such that they can be rotated around the circumference of the water tank. Also, the display control means may include a rotation driving device which rotationally drives the reels.

According to the second aspect of the present invention, reels are employed as the display means, each of which has a cylindrical shape, and each of which has multiple kinds of indicating information on the outer face thereof. Furthermore, the reels are provided such that they can be rotated around the circumference of the water tank. Furthermore, a rotation driving device, which rotationally drives the reels, is employed as the display control means.

Such an arrangement provides a game executed using the reels. With such an arrangement, the reels are rotated around the circumference of the water tank. Such an arrangement allows the multiple kinds of indicating information provided on the outer faces of the reels and the water tank to be displayed in a superimposed manner.

Thus, such an arrangement provides further improved visual effects by using the water tank, while facilitating the player's ability to visually recognize the information displayed by the display means.

In a third aspect of the gaming machine as described in the first aspect of the present invention, the display means may include a liquid crystal display device which is disposed forward of the water tank, and which provides a function of displaying indicating information variably and statically. Also, the display control means may include a display control circuit which controls the liquid crystal display device.

According to the third aspect of the present invention, a liquid crystal display device is employed as the display means. The liquid crystal display device is disposed forward of the water tank. Furthermore, the display control circuit, which controls the liquid crystal display device, is employed as the display control means.

Such an arrangement provides a function of displaying the indicating information variably and statically. In addition, the liquid crystal display device is formed of a translucent material, and is disposed forward of the water tank. Such an arrangement allows the indicating information and the water tank to be displayed in a superimposed manner.

Thus, such an arrangement provides further improved visual effects by using the water tank, while facilitating the player's ability to visually recognize the information displayed by the display means.

According to the present invention, the water tank, which retains liquid, is disposed behind the display screen that displays the indicating information, which is provided via the display means formed of a translucent material. Thus, such an arrangement provides further improved visual effects by using the water tank, while facilitating the player's ability to visually recognize the information displayed by the display means.

DETAILED DESCRIPTION OF THE INVENTION

A detailed description is provided below regarding embodiments of the present invention.

First Embodiment

Figure 1:
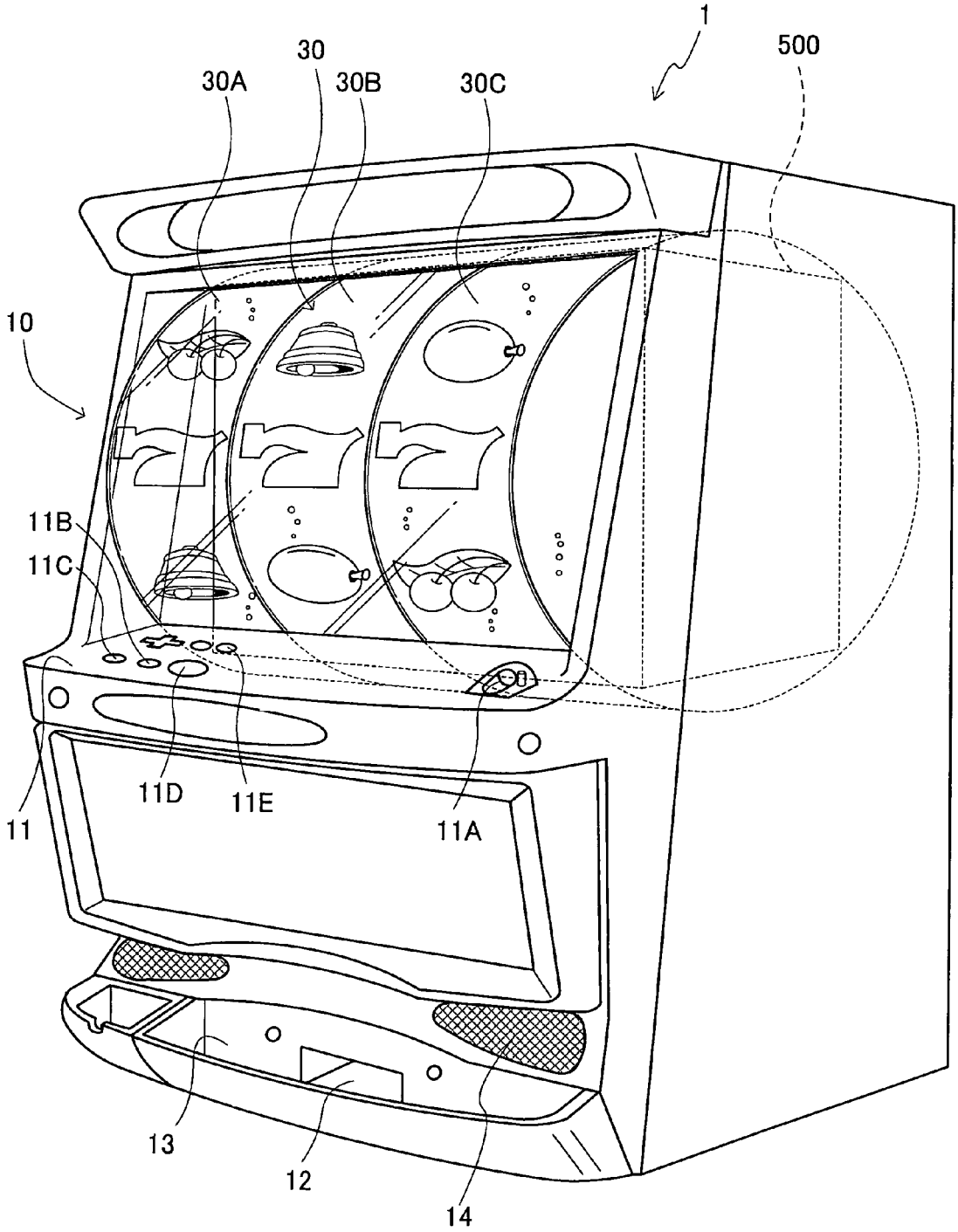
FIG. 1 is a perspective view showing the exterior of a slot machine according to a first embodiment of the present invention.

FIG. 1 is a perspective view showing the exterior of a slot machine 1 according to a first embodiment of the present invention. The slot machine 1 according to the embodiment of the present invention includes a reel group 30, an operation panel 11, a coin payout opening 12, a coin tray 13, and a sound output unit 14. It should be noted that slot machines can be roughly classified into two types. One is a slot machine having a configuration in which mechanical reels are rotated. The other is a so-called video slot machine having a configuration in which multiple virtual reels are rotated in the form of an image displayed on a screen. While a description is provided in the present embodiment regarding a slot machine employing mechanical reels, the present invention may also be applied to a video slot machine.

The slot machine 1 is installed at a predetermined location in an amusement facility such as a casino, etc. Furthermore, the slot machine 1 includes a control device 100 (see FIG. 3) or the like mounted therewithin for electrically controlling each component thereof. A description is provided later regarding the control device 100.

The reel group 30 has a structure in which three cylindrical mechanical reels 30A through 30C are rotatably provided along a horizontal line. Furthermore, the mechanical reels 30A through 30C are provided such that they can rotate around the circumference of a water tank 500. Multiple kinds of indicating information are provided on the outer face of each of the mechanical reels 30A through 30C. Such an arrangement displays the indicating information variably and statically on a display screen 10 that allows the player to recognize the indicating information. The multiple kinds of indicating information include a "red 7" design, a "blue 7"

design, a "BAR" design, a "bell" design, a "watermelon" design, and a "cherry" design. Here, each of the three mechanical reels 30A through 30C is formed of a translucent material.

In other words, the mechanical reels 30A through 30C provide a function of displaying the multiple kinds of indicating information variably and statically. That is to say, the mechanical reels 30A through 30C serve as an example of a display means formed of a translucent material. Furthermore, each of the mechanical reels 30A through 30C is formed in a cylindrical shape, on the outer face of which are depicted multiple kinds of indicating information. Each reel is provided such that it can be rotated around the circumference of the water tank.

The operation panel 11 includes a coin insertion opening 11A which allows the player to insert coins into the slot machine 1. Furthermore, the operation panel 11 includes a BET switch 11B which allows the player to select the number of coins, which will serve as the units of the gaming medium used in the game by the player. Moreover, the operation panel 11 includes a spin repeat bet switch 11C which allows the player to play the game again without changing the number of coins to be spent in the game from that in the immediately previous game. The slot machine 1 allows the player to set the number of coins to be spent in the game by performing a pushing operation on either the BET switch 11B or the spin repeat bet switch 11C.

Furthermore, the operation panel 11 includes a start switch 11D, which is a game start instruction, receiving means that allows the player to input the game start instruction in increments of games. With the slot machine 1, upon the player performing a pushing operation on either the spin repeat bet switch 11C or the start switch 11D, a start operation signal is transmitted to a CPU 106 (see FIG. 3) described later. This starts the game, upon which a scrolling operation is performed for the reel group 30.

Furthermore, the operation panel 11 includes a payout switch 11E. Upon the player performing a pushing operation on the payout switch 11E, the coins inserted by the player are paid out via the coin payout opening 12. The coins to be paid out are retained in the coin tray 13.

Figure 2:
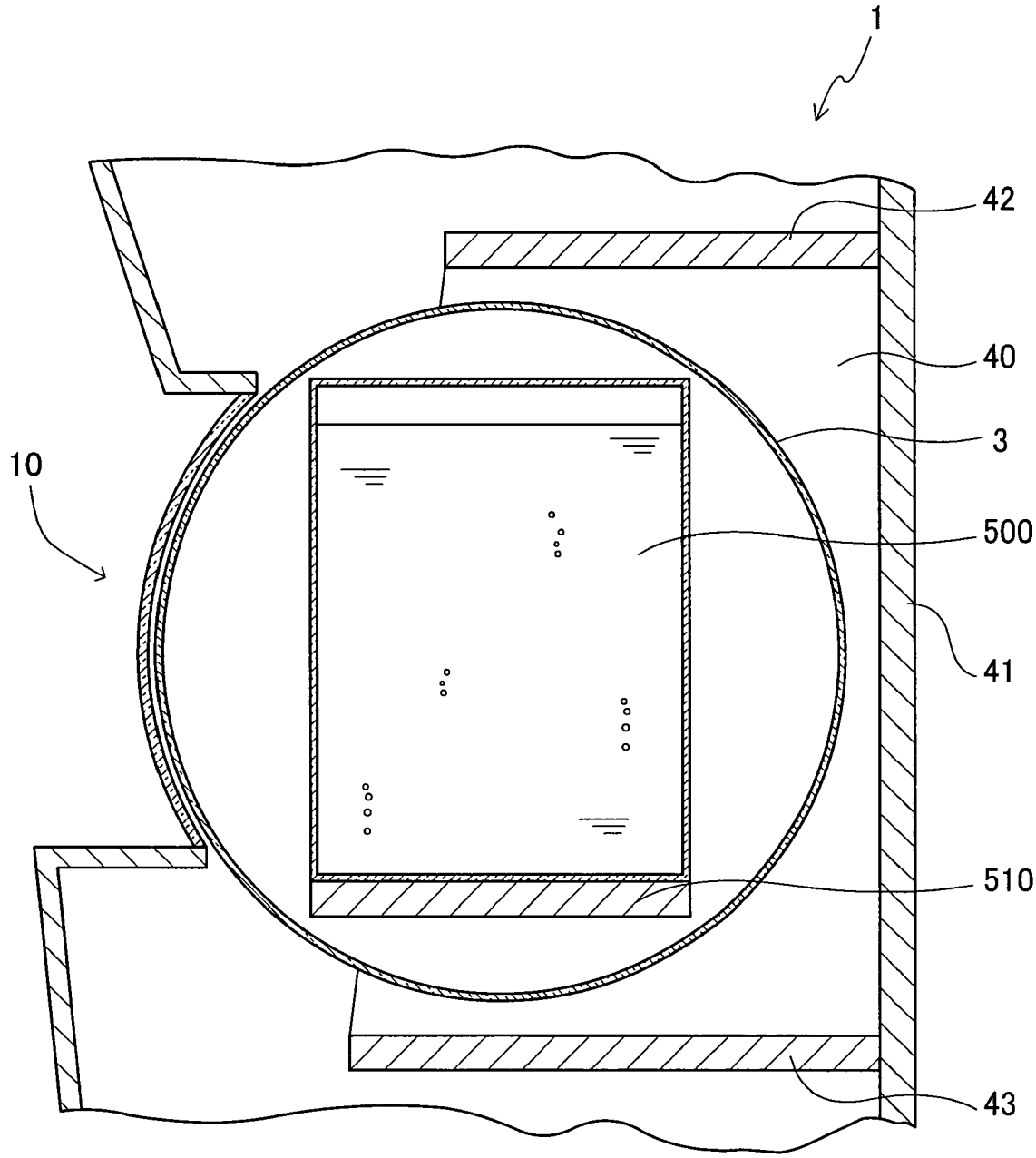
FIG. 2 is a cross-sectional view showing a reel group and a water tank included in the slot machine according to the first embodiment of the present invention.

FIG. 2 is a cross-sectional diagram showing the reel group 30 and the water tank 500 included in the slot machine 1 according to the first embodiment of the present invention.

Each of the mechanical reels 30A through 30C is independently rotatably supported by a reel frame 40. It should be noted that an unshown stepping motor is provided to the reel frame 40 for providing a function of rotating each of the mechanical reels 30A through 30C, and a function of stopping the rotation thereof. The reel frame 40 is provided between an upper frame 42 and a lower frame 43 disposed to a main frame 41.

The water tank 500 is provided in the space within the three cylindrical mechanical reels 30A through 30C, and is supported by the cabinet of the slot machine 1 through a water tank frame 510. Here, the water tank 500 is formed in the shape of a substantially rectangular parallelepiped, and is formed of a translucent material that is capable of retaining liquid. It should be noted that the water tank 500 according to the present embodiment is not restricted to such an arrangement. Rather, the water tank 500 may be formed in a desired shape, e.g., substantially in the shape of a cylinder. Also, various kinds of items for providing visual effects may be arranged within the water tank 500 (examples of which include simulated pirate ships, simulated tropical fish, and simulated aquatic plants, all of which can be moved by magnetic force).

In other words, the water tank 500 is provided behind the display screen that serves as a display means for displaying the indicating information. Here, the water tank 500 is a water tank that is capable of retaining liquid, and which is formed of a translucent material, for example.

Next, a description is provided regarding a configuration of the control device 100.

Figure 3:
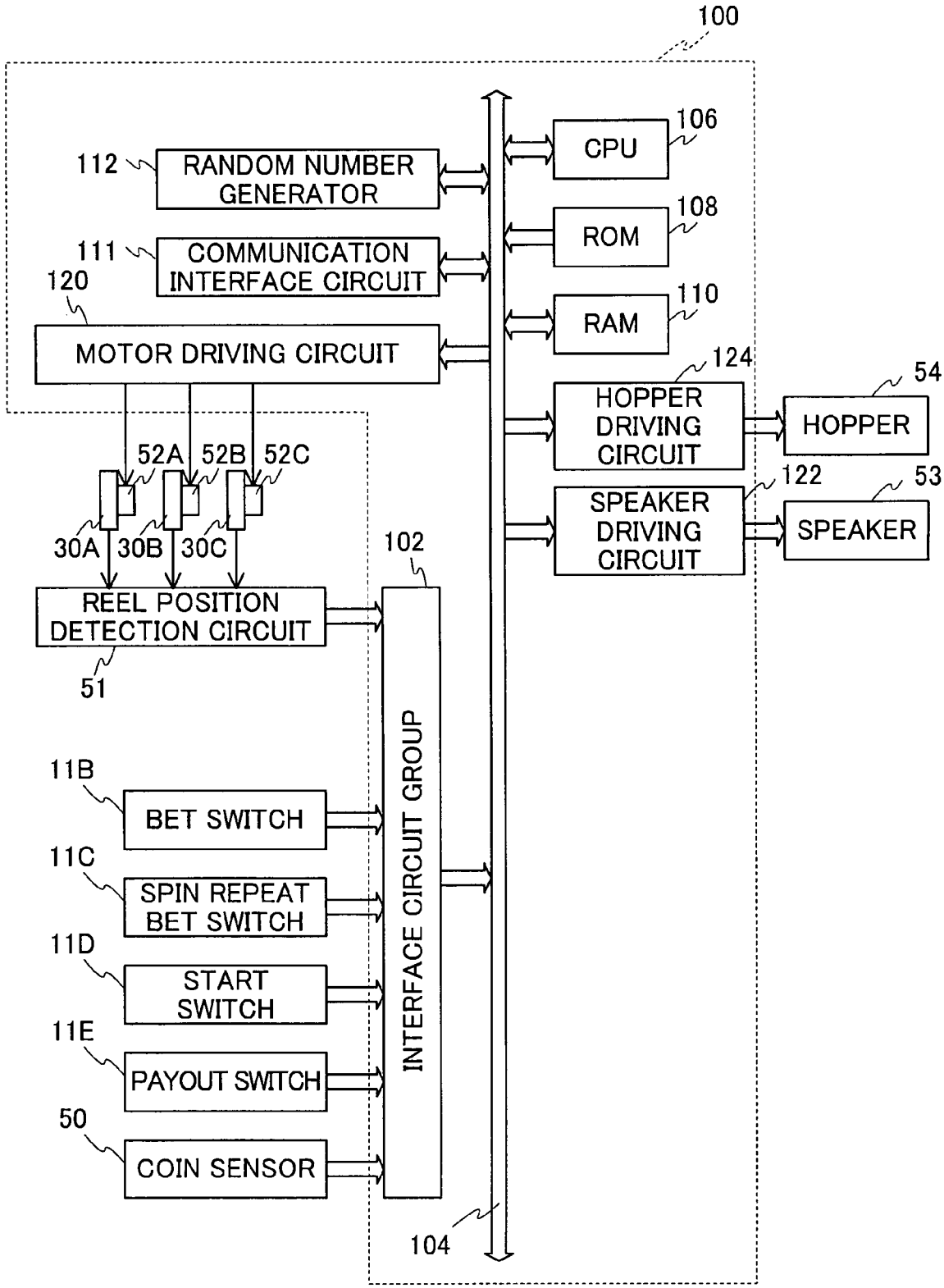
FIG. 3 is a block diagram showing an electrical configuration of a control device according to the embodiment of the present invention.

FIG. 3 is a block diagram showing an electrical configuration of the control device 100 according to the embodiment of the present invention.

The control device 100 is a microcomputer, and includes an interface circuit group 102, an input/output bus 104, a CPU 106, ROM 108, RAM 110, a communication interface circuit 111, a random number generator 112, a motor driving circuit 120, a speaker driving circuit 122, and a hopper driving circuit 124.

The interface circuit group 102 is connected to the input/output bus 104. Furthermore, the input/output bus 104 inputs and outputs data signals or address signals to and from the CPU 106.

The start switch 11D is connected to the interface circuit group 102. The start signal output from the start switch 11D is converted into a predetermined signal by the interface circuit group 102, and the start signal thus converted is supplied to the input/output bus 104.

Furthermore, the BET switch 11B, the spin repeat bet switch 11C, and the payout switch 11E are connected to the interface circuit group 102. Each of the switching signals output from the switches 11B, 11C, and 11E is also supplied to the interface circuit group 102, and is converted into a predetermined signal by the interface circuit group 102. The switching signals thus converted are supplied to the input/output bus 104.

Moreover, a coin sensor 50 is connected to the interface circuit group 102. The coin sensor 50 is a sensor for detecting the coins inserted into the coin insertion opening 11A. The coin sensor 50 is provided in combination with the coin insertion opening 11A. The sensing signal output from the coin sensor 50 is also supplied to the interface circuit group 102, and is converted into a predetermined signal by the interface circuit group 102. The sensing signal thus converted is supplied to the input/output bus 104.

In addition, a reel position detecting circuit 51 is connected to the interface circuit group 102. The reel position detecting circuit 51 is a circuit for detecting the rotational position for each of the mechanical reels 30A through 30C based upon the pulse signals received from a reel rotational position sensor (not shown). The detection signal output from the reel position detecting circuit 51 is also supplied to the interface circuit group 102, and is converted into a predetermined signal by the interface circuit group 102. The detection signal thus converted is supplied to the input/output bus 104.

Furthermore, the ROM 108 and the RAM 110 are connected to the input/output bus 104.

According to a program stored in the ROM 108, which is described later in detail, the CPU 106 controls the overall operation of, and the game provided by, the slot machine 1.

The ROM 108 stores: a control program for central control of the slot machine 1; initial data for executing the control program; and various data tables used in the lottery processing.

The RAM 110 temporarily stores flags, variables, etc., used for the aforementioned control program.

Moreover, a communication interface circuit 111 is connected to the input/output bus 104. The communication interface circuit 111 is a circuit for communicating with a server, etc., via various kinds of communication networks, including a public telephone line network, LAN, etc.

In addition, the random number generator 112 for generating a random number is connected to the input/output bus 104. The random number generator 112 generates a random number in a predetermined range, e.g., a range between 0 and 65535. Alternatively, an arrangement may be made in which the CPU 106 generates a random number by computation.

A motor driving circuit 120 for driving the stepping motors 52A through 52C is connected to the input/output bus 104. The CPU 106 controls the operations of the stepping motors 52A through 52C via the motor driving circuit 120 according to the occurrence of predetermined events.

Furthermore, the speaker driving circuit 122 for driving the speaker 53 is connected to the input/output bus 104. The CPU 106 reads out the sound data stored in the ROM 108, and transmits the sound data thus read out to the speaker driving circuit 122 via the input/output bus 104, thereby providing predetermined sound effects generated by the speaker 53.

Moreover, the hopper driving circuit 124 for driving the hopper 54 is connected to the input/output bus 104. Upon reception of a cash out signal input from the payout switch 11E, the CPU 106 transmits a driving signal to the hopper driving circuit 124 via the input/output bus 104. The hopper 54 then proceeds to pay out an amount of coins that corresponds to the credit remaining at the current point in time, as stored in a predetermined memory area of the RAM 110.

Figure 4:
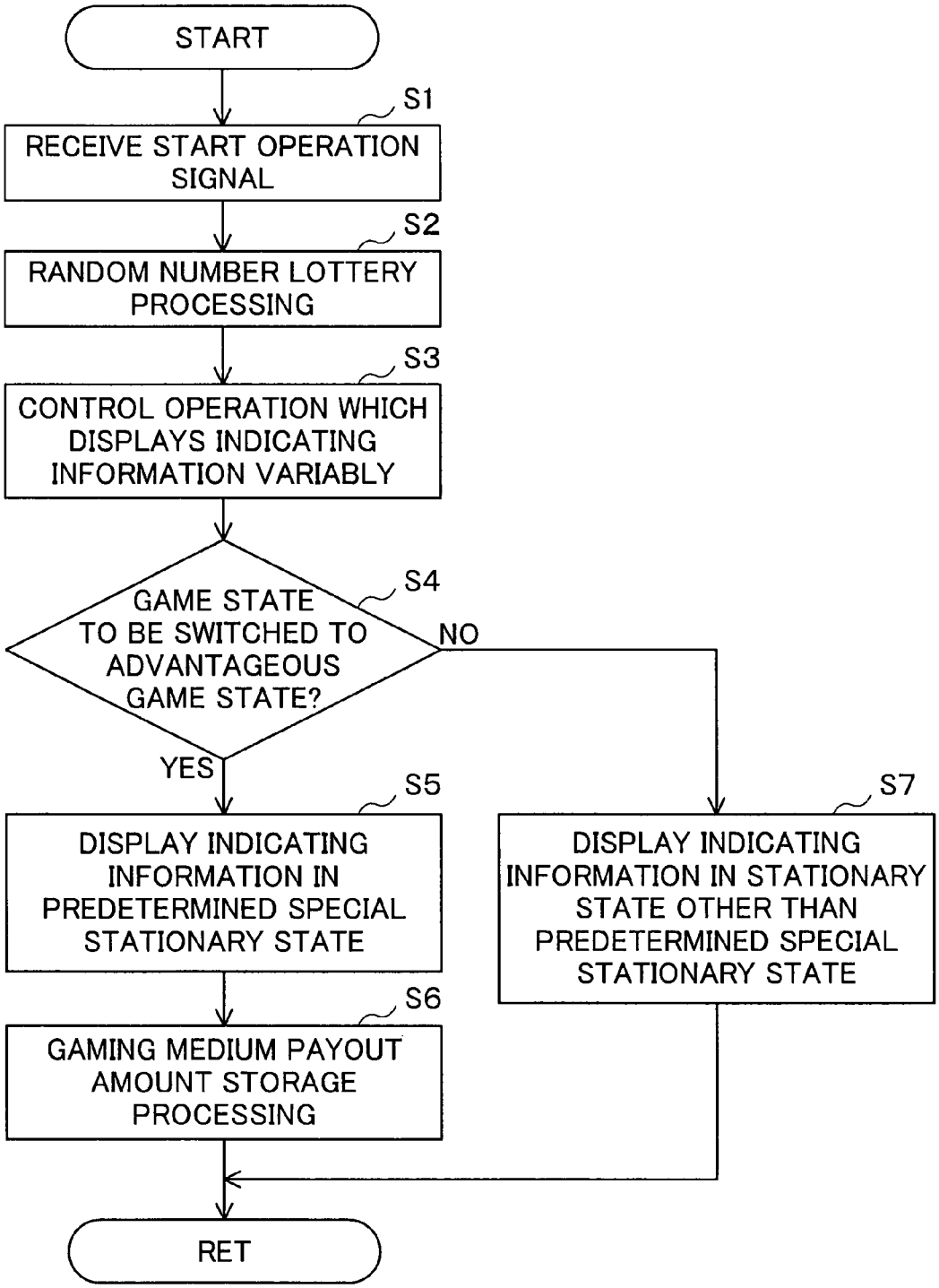
FIG. 4 is a flowchart showing a processing operation of the control device according to the embodiment of the present invention.

Next, a description is provided regarding the operation of the CPU 106 that controls the execution of a game provided by the slot machine 1 according to the first embodiment with reference to a flowchart shown in FIG. 4.

In step S1, the CPU 106 receives a start operation signal. In this processing, upon the player performing a pushing operation on either the spin repeat bet switch 11C or the start switch 11D, a start operation signal is transmitted, upon which the CPU 106 receives the start operation signal thus transmitted. Upon completion of this processing, the CPU 106 switches the processing to step S2.

In step S2, the CPU 106 performs random number lottery processing. In this processing, the CPU 106 instructs the random number generator 112 to generate a random number, and extracts the random number thus generated. Upon completion of this processing, the CPU 106 switches the processing to step S3.

In step S3, the CPU 106 performs indicating information variable display control processing. In this processing, the CPU 106 transmits a command which instructs the motor driving circuit 120 to rotate the mechanical reels 30A through 30C. Upon reception of this command, the motor driving circuit 120 performs a control operation so as to rotate the mechanical reels 30A through 30C. In other words, the motor driving circuit 120 serves as an example of a display control means which is a rotation driving device for driving the reels. Upon completion of this processing, the CPU 106 switches the processing to step S4.

In step S4, the CPU 106 determines whether or not the game state is to be switched to an advantageous game state. In this processing, the CPU 106 determines whether or not the random number thus extracted in step S2 is within a predetermined range. In a case where the CPU 106 determines that the random number is within the predetermined range, the CPU 106 determines that the game state is to be switched to the advantageous game state, upon which the processing is switched to step S5. On the other hand, in a case where the CPU 106 does not determine that the random number is within the predetermined range, the CPU 106 determines that the game state is not to be switched to the advantageous game state, upon which the processing is switched to step S6.

In other words, the CPU 106 provides: a function as an operating means which allows the player to operate the slot machine 1; and a function as an example of a game control means which determines, for every instance of the player performing an operation via the operating means, whether or not the game state is to be switched to the game state that is advantageous to the player.

The term "game state advantageous to the player" represents a state in which the following conditions are satisfied. First, in the processing in step S5 described later, the condition that the indicating information depicted on the mechanical reels 30A through 30C are displayed on the display screen 10 in a predetermined stationary state (e.g., the indicating information "red 7", "red 7", and "red 7" are rearranged in the stationary state). Second, in the processing in step S6 described later, the conditions of the gaming medium payout amount is stored in a predetermined memory region of the RAM 110, which is used in payout processing in which a predetermined amount of the gaming medium is paid out.

In step S5, the CPU 106 performs a control operation so as to display the indicating information in a predetermined special stationary state. In this processing, the CPU 106 transmits a command which is an instruction to the motor driving circuit 120 to display the indicating information depicted on the mechanical reels 30A through 30C on the display screen 10 in a predetermined special stationary state (e.g., the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in the predetermined special stationary state (e.g., the indicating information "red 7", "red 7", and "red 7" are rearranged in the stationary state). Upon completion of this processing, the CPU 106 switches the processing to step S6.

In step S6, the CPU 106 performs gaming medium payout amount storage processing. In this processing, the CPU 106 stores the gaming medium payout amount, which is used in the processing in which a predetermined amount of the gaming medium is paid out, in a predetermined memory region of the RAM 110, according to the determination made in step S4 that the game state is to be switched to a special game state advantageous to the player. Upon completion of this processing, the CPU 106 ends one game.

In step S7, the CPU 106 performs a control operation so as to display the indicating information in a stationary state other than the aforementioned predetermined special state. In this processing, the CPU 106 transmits a command which is an instruction to the motor driving circuit 120 to display the indicating information depicted on the mechanical reels 30A through 30C on the display screen 10 in a stationary state other than the aforementioned predetermined special stationary state (e.g., the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in a stationary state other than the aforementioned predetermined special stationary state. Upon completion of this processing, the CPU 106 ends one game.

In other words, the CPU 106 provides a function as an example of a game control means which controls the execution of a game.

The first embodiment provides the following advantages.

(1) The mechanical reels 30A through 30C formed of a translucent material provide a function of displaying the multiple kinds of indicating information variably and statically. The motor driving circuit 120 controls the display operation for displaying the indicating information depicted on the mechanical reels 30A through 30C variably and statically according to the execution of a game controlled by the CPU 106. Furthermore, the water tank 500, which is capable of retaining liquid and formed of a translucent material, is provided behind the display screen 10 that displays the indicating information depicted on the mechanical reels 30A through 30C.

With such an arrangement, the water tank 500, which retains liquid, is provided behind the display screen 10 for the mechanical reels 30A through 30C that display the multiple kinds of indicating information variably and statically. Such an arrangement allows the player to recognize both the multiple kinds of indicating information depicted on the mechanical reels 30A through 30C displayed on the display screen 10 and the water tank 500 provided behind the display screen 10. Furthermore, with such an arrangement, the water tank 500 can be designed without having to take into account a concern of whether or not the water tank 500 interrupts the player's view of the display screen 10 that displays the indicating information depicted on the mechanical reels 30A through 30C. Thus, with such an arrangement, the water tank 500 can be formed with an increased depth as compared with an arrangement in which the water tank 500 is provided forward of the mechanical reels 30A through 30C. Such a water tank 500 thus designed allows various kinds of items providing visual effects (e.g., simulated pirate ships, simulated tropical fish, and simulated aquatic plants, all of which can be moved by magnetic force) to be arranged therewithin.

Thus, such an arrangement provides improved visual effects by using the water tank 500, while facilitating the player's ability to visually recognize the information displayed on the mechanical reels 30A through 30C.

(2) The cylindrical mechanical reels 30A through 30C, each of which has multiple kinds of indicating information provided on the outer face thereof, are employed as a display means. Furthermore, the mechanical reels 30A through 30C are provided such that they can be rotated around the circumference of the water tank 500. On the other hand, the motor driving circuit 120, which rotationally drives the reels, is employed as a display control means. Such an arrangement provides a game using the mechanical reels 30A through 30C. Furthermore, with such an arrangement, the mechanical reels are rotated around the circumference of the water tank 300. Such an arrangement allows the multiple kinds of indicating information provided on the outer faces of the mechanical reels 30A through 30C and the water tank 500 to be displayed in a superimposed manner.

Thus, such an arrangement provides improved visual effects by using the water tank 500, while facilitating the player's ability to visually recognize the information displayed on the mechanical reels 30A through 30C.

Second Embodiment

In the following description of a second embodiment, the same components as those in the first embodiment are denoted by the same reference numerals, and descriptions thereof are omitted or simplified.

Figure 5:
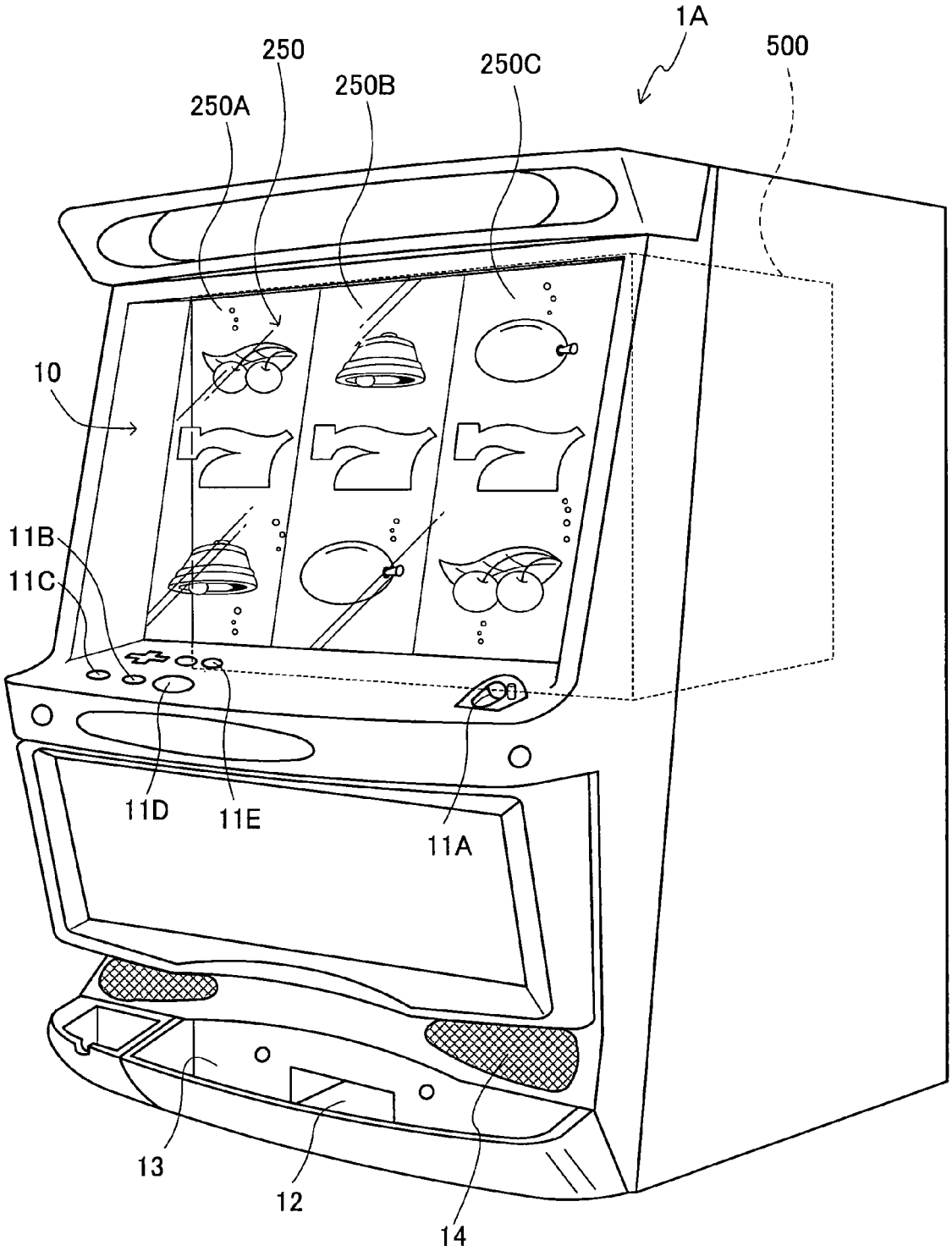
FIG. 5 is a perspective view showing the exterior of a slot machine according to a second embodiment of the present invention.

FIG. 5 is a perspective view showing the exterior of a slot machine 1A according to the second embodiment of the present invention.

Figure 6:
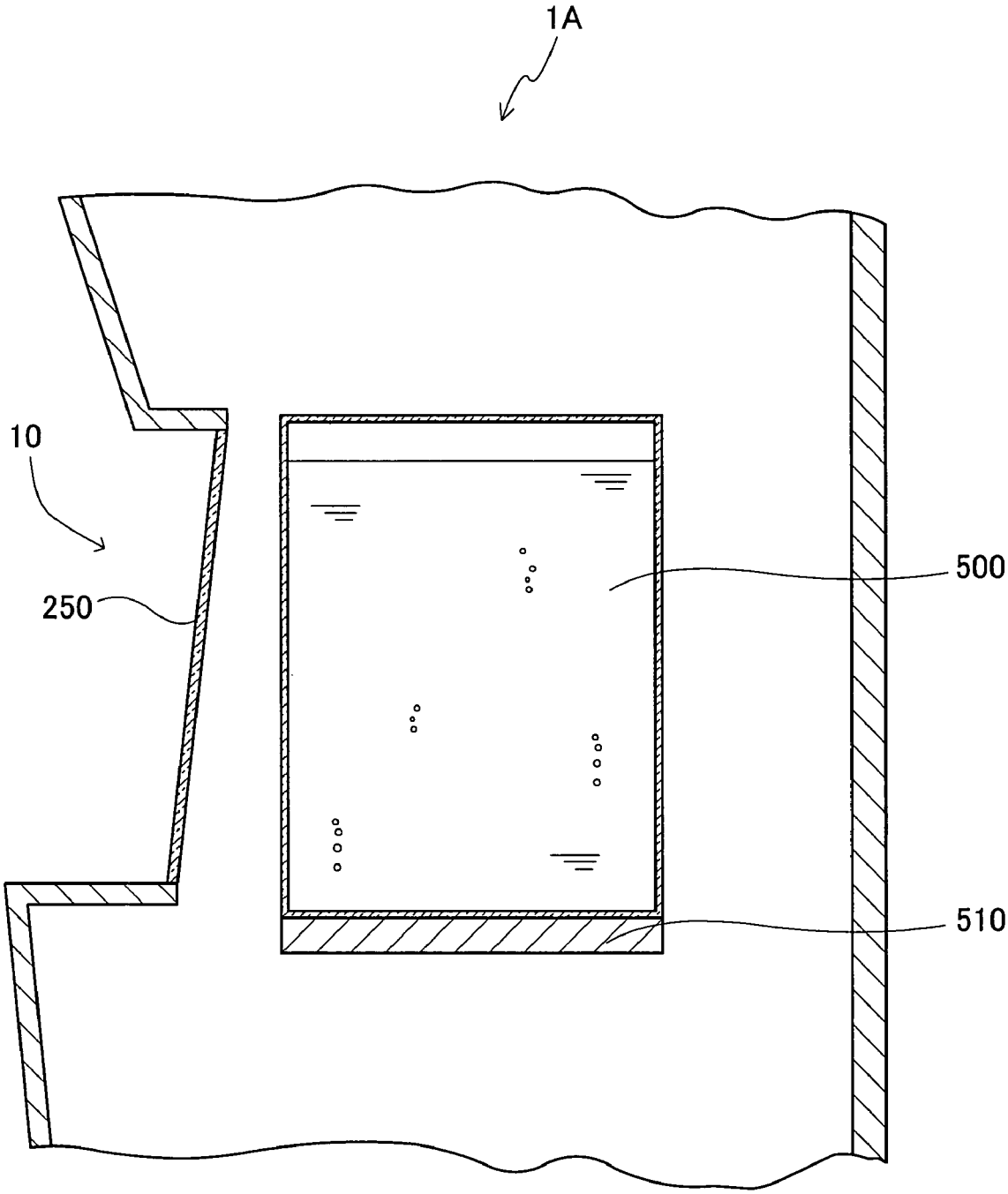
FIG. 6 is a cross-sectional view showing a liquid crystal display device and a water tank included in the slot machine according to the second embodiment of the present invention.

FIG. 6 is a cross-sectional view of a liquid crystal display device 250 and the water tank 500 included in the slot machine 1A according to the second embodiment of the present invention.

The slot machine 1A according to the second embodiment includes the liquid crystal display device 250 instead of the mechanical reels 30A through 30C included in the first embodiment, which is a point of difference from the first embodiment.

Furthermore, the slot machine 1A according to the second embodiment includes a display control device 200 instead of the motor driving circuit 120 included in the first embodiment, which is another point of difference from the first embodiment.

The liquid crystal display device 250 is provided forward of the water tank 500, and has a function of displaying multiple kinds of indicating information on three indicating information display regions 250A through 250C variably and statically. Here, each of the three indicating information display regions 250A through 250C has a structure in which a transparent substrate such as a glass substrate, upon which a thin film transistor layer has been formed, and another transparent substrate are mounted so as to face each other with a certain gap between them, and the gap between the substrates is filled with a liquid crystal.

In other words, the liquid crystal display device 250 is provided forward of the water tank, and serves as an example of a liquid crystal display device which provides a function of displaying the indicating information variably and statically.

Figure 7:
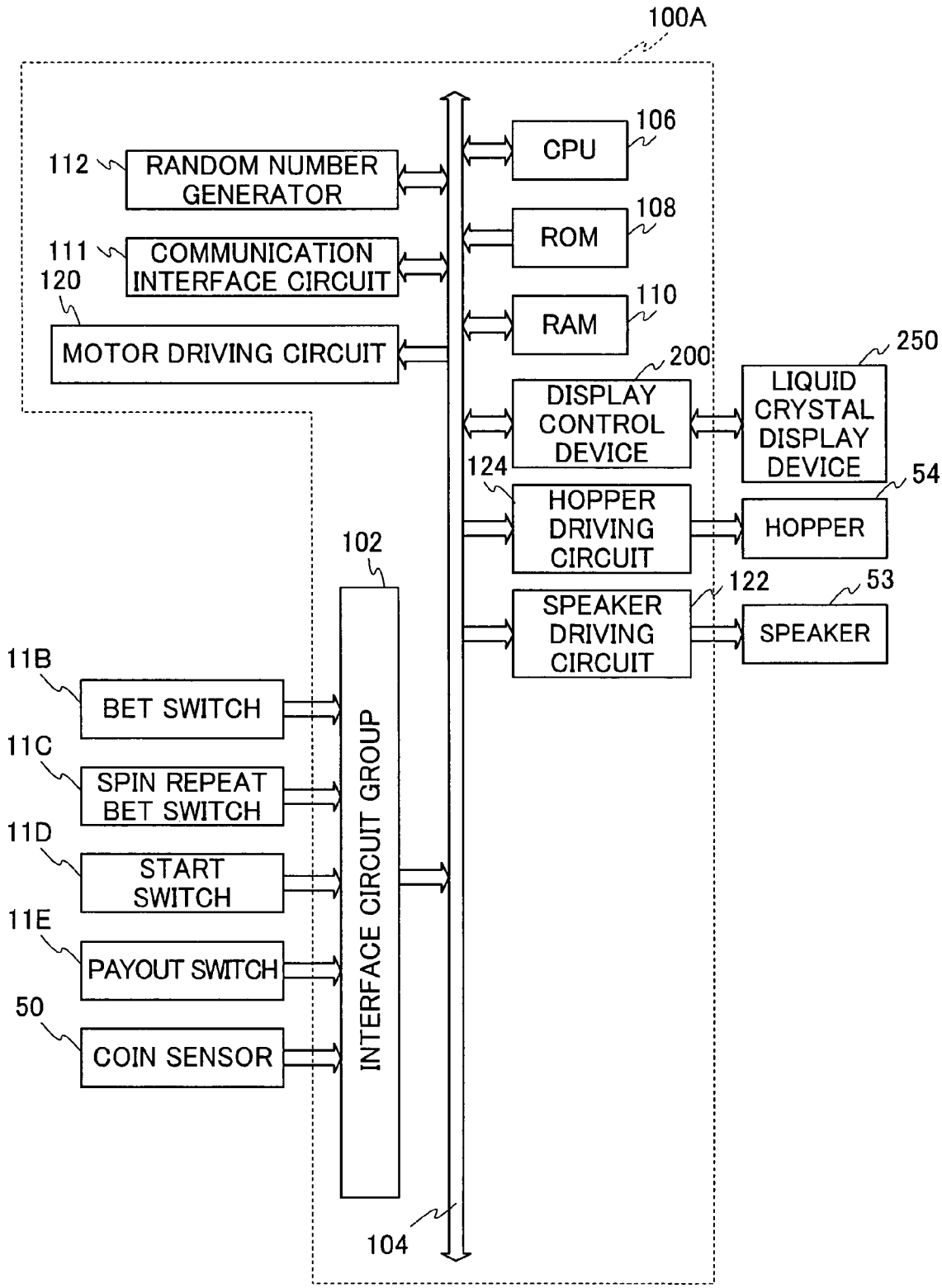
FIG. 7 is a block diagram showing an electrical configuration of a control device according to the embodiment of the present invention.

FIG. 7 is a block diagram showing an electrical configuration of a control device 100A according to the embodiment of the present invention.

The display control device 200 is connected to the input/output bus 104. The CPU 106 generates an image display command corresponding to the state and results of the game, and outputs the image display command thus generated to the display control device 200 via the input/output bus 104. Upon reception of the image display command as an input signal from the CPU 106, the display control device 200 generates a driving signal for driving the liquid crystal display device 250 according to the image display command thus received. Then, the display control device 200 outputs the driving signal thus generated to the liquid crystal display device 250. With such an arrangement, the liquid crystal display device 250 provides a function of displaying multiple kinds of indicating information on the indicating information display regions 250A through 250C variably and statically.

In other words, the display control device 200 serves as an example of a display control means, which is a display control circuit that controls the liquid crystal display device.

Next, a description is provided regarding the processing performed by the CPU 106 which executes a game provided by the slot machine 1 according to the second embodiment with reference to the flowchart shown in FIG. 4.

The processing denoted by step S1 and the processing denoted by step S2 are the same as those in the first embodiment.

In step S3, the CPU 106 performs indicating information variable display control processing. In this processing, the CPU 106 transmits a command to the display control device 200, which instructs the liquid crystal display device 250 to display the multiple kinds of indicating information variably. Upon reception of this command, the display control device 200 performs a control operation so as to display the multiple kinds of indicating information on the indicating information display regions 250A through 250C of the liquid crystal display device 250 variably. Upon completion of this processing, the CPU 106 switches the processing to step S4.

The processing denoted by step S4 is the same as that in the first embodiment.

In step S5, the CPU 106 performs a control operation so as to display the indicating information in a predetermined special stationary state. In this processing, the CPU 106 transmits a command to the display control device 200, which instructs the liquid crystal display device 250 to display the multiple kinds of indicating information in the predetermined special stationary state (e.g., the indicating information "red 7", "red 7", and "red 7" are rearranged in the stationary state). After the multiple kinds of indicating information have been displayed on the indicating information display regions 250A through 250C of the liquid crystal display device 250 variably, upon reception of the command, the display control device 200 performs a control operation so as to display the indicating information in the predetermined special stationary state (e.g., the indicating information "red 7", "red 7", and "red 7" are rearranged in the stationary state). Upon completion of this processing, the CPU 106 switches the processing to step S6.

The processing denoted by step S6 is the same as that in the first embodiment.

In step S7, the CPU 106 performs a control operation so as to display the indicating information in a stationary state other than the aforementioned predetermined special state. In this processing, the CPU 106 transmits a command to the display control device 200, which instructs the liquid crystal display device 250 to display the indicating information in a stationary state other than the aforementioned predetermined special stationary state (e.g., the indicating information "red 7", "red 7", and "red 7" are rearranged in the stationary state) after the multiple kinds of indicating information have been displayed variably. Upon reception of this command, the display control device 200 performs a control operation so as to display the indicating information on the indicating information display regions 250A through 250C of the liquid crystal display device 250 in a stationary state other than the special stationary state after multiple kinds of indicating information have been displayed variably. Upon completion of this processing, the CPU 106 ends one game.

The second embodiment provides the following advantages.

(3) The liquid crystal display device 250, which is disposed forward of the water tank 500, is employed as a display means. Furthermore, the display control device 200, which controls the liquid crystal display device 250, is employed as a display control means.

Such an arrangement allows the indicating information to be displayed variably and statically using various images. Furthermore, with such an arrangement, the liquid crystal display device 250 is formed of a translucent material, and is disposed forward of the water tank 500. Such an arrangement allows the indicating information and the water tank to be displayed in a superimposed manner.

Thus, such an arrangement provides improved visual effects by using the water tank, while facilitating the player's ability to visually recognize the information displayed by the display means.

The embodiments according to the present invention have been described above with reference to specific examples for exemplary purpose only, and it should be clearly understood that the embodiments in no way restrict the present invention. That is to say, the gaming machine according to the present invention principally includes: a game control means for controlling execution of the game; a display means, which is formed of a translucent material, for providing a function of displaying multiple kinds of indicating information variably and statically; a display control means for controlling the display operation of the aforementioned display means for displaying the indicating information variably and statically as the game is executed under the control of the aforementioned game control means; and a water tank which is formed of a translucent material, retains liquid, and is provided behind the display screen of the aforementioned display means for displaying the indicating information. With such an arrangement, the components such as the game control means, the display means, the display control means, the water tank, etc., may be modified and altered as suitable.

Moreover, it should be noted that the advantages described in association with the embodiments of the present invention are merely a listing of the most preferred advantages of the present invention, and that the advantages of the present invention are by no means restricted to those described in connection with the embodiments of the present invention.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

[Explanation of the Reference Symbols]

1, 1A: slot machine
10: display screen
11: operation panel
12: coin payout opening
13: coin tray
14: sound output unit
30: reel group
30A to 30E: mechanical reel
100: control device
102: interface circuit group
104: input/output bus
106: CPU
108: ROM
110: RAM
111: communication interface circuit
112: random number generator
120: motor driving circuit
122: speaker driving circuit
124: hopper driving circuit
128: display unit driving circuit
200: display control device
250: liquid crystal display device
500: water tank

What is claimed is:

1. A gaming machine comprising:

a game control device for controlling execution of game;

a display device for displaying a plurality of kinds of indicating information variably and statically, and which is formed of a translucent material;

a display control device for controlling display operation of the display device for displaying indicating information variably and statically during the execution of the game under the control of the game control device; and a water tank which is disposed behind a display screen of the display device for displaying indicating information, retains liquid, and is formed of a translucent material;

wherein the display device comprises cylindrical reels having a plurality of kinds of indicating information provided on the outer face thereof, and which are disposed to be rotatable around the circumference of the water tank, and wherein the display control device comprises a rotation driving device which rotationally drives the reels.

2. A gaming machine comprising:

a game control device for controlling execution of game;

a display device for displaying a plurality of kinds of indicating information variably and statically, and which is formed of a translucent material;

a display control device for controlling display operation of the display device for displaying indicating information variably and statically during the execution of the same under the control of the game control device; and a water tank which is disposed behind a display screen of the display device for displaying indicating information, retains liquid, and is formed of a translucent material;

wherein the display device comprises a liquid crystal display device which is disposed forward of the water tank, and provides a function of displaying indicating information variably and statically, and wherein the display control device comprises a display control circuit which controls the liquid crystal display device.

* * * * *